US006519900B1

(12) United States Patent
Pierce

(10) Patent No.: US 6,519,900 B1
(45) Date of Patent: Feb. 18, 2003

(54) MODULAR SCHOOL BUILDING SYSTEM

(75) Inventor: Alan Pierce, Murrieta, CA (US)

(73) Assignee: Turnkey Schools of America, Temecula, CA (US)

( * ) Notice: Subject to any disclaimer, the term of this patent is extended or adjusted under 35 U.S.C. 154(b) by 0 days.

(21) Appl. No.: 09/616,486

(22) Filed: Jul. 14, 2000

Related U.S. Application Data

(60) Provisional application No. 60/215,515, filed on Jun. 30, 2000.

(51) Int. Cl.[7] ..... E04B 7/16

(52) U.S. Cl. ..... 52/66; 52/79.5; 52/79.12; 52/90.1; 52/293.3; 52/274; 52/641; 52/745.14

(58) Field of Search ..... 52/66, 79.5, 79.9, 52/79.12, 90.1, 641, 653.1, 745.14, 293.3, 294, 295, 296, 299, 274, 86, 143

(56) References Cited

U.S. PATENT DOCUMENTS

| | | | | | |
|---|---|---|---|---|---|
| 3,229,431 | A | * | 1/1966 | Paul | |
| 3,404,496 | A | * | 10/1968 | Ballard | 52/641 |
| 3,485,346 | A | * | 12/1969 | Ballard | 52/66 |
| 3,605,355 | A | * | 9/1971 | Solesbee | 52/641 X |
| 3,638,373 | A | * | 2/1972 | Chapman | 52/79.5 X |
| 3,736,708 | A | * | 6/1973 | Chapman | 52/641 X |
| 3,760,550 | A | * | 9/1973 | Mueller et al. | 52/641 |
| 3,785,108 | A | * | 1/1974 | Satchell | 52/645 |
| 3,812,638 | A | * | 5/1974 | Larch et al. | 52/745.14 |
| 3,863,419 | A | * | 2/1975 | Hendrich | 52/745.14 |
| 3,881,285 | A | * | 5/1975 | Schumaker | |
| 3,890,747 | A | * | 6/1975 | Van Der Lely | 52/64 |
| 4,078,353 | A | * | 3/1978 | Thesingh | 52/741 |
| 4,160,340 | A | * | 7/1979 | Levett | |
| 4,170,852 | A | * | 10/1979 | Danis | 52/71 |
| 4,211,504 | A | * | 7/1980 | Sivachenko | |
| 4,219,982 | A | * | 9/1980 | Hart | 52/641 |
| 4,296,584 | A | * | 10/1981 | Lempa | 52/169.13 X |
| 4,854,094 | A | * | 8/1989 | Clark | |
| 4,926,591 | A | * | 5/1990 | Buijs | 52/745.14 X |
| 4,982,545 | A | * | 1/1991 | Stromback | 52/639 |
| 5,044,134 | A | * | 9/1991 | Brockway | 52/79.1 |
| 5,333,421 | A | * | 8/1994 | McKenna | |
| 5,341,611 | A | * | 8/1994 | Lewis | 52/90.1 |
| 5,596,844 | A | * | 1/1997 | Kalinowski | 52/79.5 |
| 5,819,492 | A | * | 10/1998 | Konicek | 52/641 |
| 5,890,339 | A | * | 4/1999 | Willis | 52/640 |
| 6,041,561 | A | * | 3/2000 | LeBlang | 52/234 |
| 6,131,343 | A | * | 10/2000 | Jackson | 52/86 |
| 6,173,726 | B1 | * | 1/2001 | Talmadge | 52/641 X |
| 6,256,960 | B1 | * | 7/2001 | Babcock et al. | 52/592.1 |

FOREIGN PATENT DOCUMENTS

| | | | | |
|---|---|---|---|---|
| DE | 26 41 247 | * | 3/1977 | 52/641 |

* cited by examiner

*Primary Examiner*—Robert Canfield
(74) *Attorney, Agent, or Firm*—Knobbe, Martens, Olson & Bear, LLP.

(57) ABSTRACT

A substantially preassembled modular frame system for erecting permanent school buildings. The system design, materials, and construction have been pre-approved by state inspectors. The system provides a roof that is extensible from a low position that is configured to permit the system to be transported on highways and fit under common overpasses and bridges to a pitched position that provides a sloped roof profile to improve insulation factors of completed buildings and better shed rain, snow, and debris. The system includes anchor assemblies that are rigidly connected to the frame to inhibit uplift forces acting on the building from distorting or dislodging the building from the foundation. The system also includes preassembled wall panels and a convenient mechanism for emplacing and securing the wall panels within the modular frames.

50 Claims, 11 Drawing Sheets

MODULAR SCHOOL BUILDING SYSTEM

RELATED APPLICATIONS

This application claims the benefit of U.S. Provisional Application No. 60/215515 filed Jun. 30, 2000.

BACKGROUND OF THE INVENTION

1. Field of the Invention

The present invention relates to the field of building construction and, in particular, to a modular system for assembling school buildings.

2. Description of the Related Art

School construction has typically proceeded in a manner very similar to that of traditional residential home construction. An architect first drafts a set of plans for the building. The plans are then checked and approved by the client and the responsible regulatory agency. The design, drafting, and approval process typically takes a year or so, particularly as changes are often required by the client or the approval entity. Once the plans are approved, the actual construction of the building takes place, commencing typically with preparing the building site by clearing and leveling the land. The foundation is then prepared, the frame of the building is erected, covering material is applied to the interior and exterior of the building, and the interior flooring and windows and door are installed. Plumbing and electrical wiring are also installed along with increasingly common telephone and high-speed communication lines.

While ground up construction offers the advantage that a school can be thereby designed and built specifically for the requirements of a particular building location and client, this specificity incurs significant costs in architect's and approval fees and time. The typical duration for building a traditional permanent school is four years from inception to completion. With the rapidly changing populations, particularly of school age children, that many portions of the country are experiencing, a four year lag time from request to build a new school building until it is ready for use imposes a significant burden to the schools and the children using them.

As an alternative to site assembled permanent structures, partially premanufactured school buildings are sometimes used. The portable buildings may be single structures, similar to mobile homes, or more typically, consist of two structures, each enclosed on three sides with one open wall that are joined together at the open walls to form single structures. The partially preassembled buildings, typically referred to as "portables", are placed on a foundation pad. Plumbing, electrical wiring, telephone lines, and heating, ventilation and air conditioning (HVAC) systems are installed. Portables are available in standard sizes and typically come with insulation, exterior wall finishing, and roofs already included.

In order to be portable, the structure and materials of the portable buildings are typically lightweight and the size of the structure is such as to fit under overpasses and bridges over roads. While convenient, the lightweight construction and size of portables presents several drawbacks to their use as school buildings. They generally employ a limited amount of insulation in the walls and roof and are often placed directly on a wood foundation. Thus, the insulative capabilities of a portable are generally lower and the associated heating and cooling costs are generally higher than for a better-insulated permanent building of comparable size. In addition, the light structure and the typical manner of joining the two separate sections of typical portables makes the portable buildings not as structurally durable over time. They tend to develop creaky floors and windows and doorframes that distort and make the opening and closing of the windows and doors problematic. The joint between the two sections of the portable is a potential source of drafts, dirt, and pests and also structural flexing.

The requirement for a portable to fit under overpasses and bridges means that, in practice, the overall height of a typical portable is limited to approximately 12 feet. The ceilings and corresponding roofs are also typically flat in order to simplify construction. The footprint of a portable building is typically constrained by the standard sizes of portables available. With a limited footprint and a ceiling that is typically no more than 9 feet high, the interior volume of a portable building is limited. This can become a concern, because a school classroom building often contains 30 or more children and adults all of who require clean air to breathe and who generate carbon dioxide as they exhale. Excessive concentration or accumulation of carbon dioxide, dust, pollen, or noxious vapors are a known health hazard, particularly around children. The limited volume of air per person of a portable building places significant demands on the building's HVAC system to provide fresh air to the inhabitants.

Another disadvantage of typical portables is the flat roof profile itself. The lack of a pitch to the roof profile allows a significant amount of snow, rainwater, dirt, and debris to accumulate on the rooftop. This imposes a significant weight load on the roof. In areas with significant snowfall, the use of buildings with flat roofs is often precluded. In addition, accumulated water and debris can attack the roofing materials leading to leaks in the roof appearing prematurely.

Also, since the roof is generally multi-layered, a leak in the outer layer will allow water to ingress, however the water may migrate laterally within the layers of a flat roof so that a water leak into the interior of the building is not necessarily immediately below the external break in the roofing material. This makes locating a leak source and repairing it more difficult.

The flat roof of a typical portable is typically separated from the interior ceiling by rafter structures and insulation material with a thickness on the order of 1 foot. The outer roof of the portable is exposed to thermal heating from the sun and cooling from exposure to the ambient air. It can be appreciated that the thermal insulation factor of a portable with a flat roof surface in relative proximity to the interior ceiling is inferior in comparison to that of a permanent structure with a pitched roof profile and an enclosed dead air space between the roof surface and the interior ceiling surface, assuming comparable insulation materials in the two structures. In practice, a permanent structure with an upper roof displaced from the ceiling provides additional space for dedicated insulation material in comparison to a portable with the upper roof and the ceiling positioned adjacent each other.

Many portable building designs lack provision for securely fastening the building to the foundation. A secure attachment is required to inhibit uplift of the building from the foundation in case of a seismic event or high wind conditions. The anchoring methods utilized by many portable designs incorporates metal strapping or anchors shot into the foundation that are typically not strong enough to inhibit building uplift in an extreme stress event.

It can be appreciated that there is an ongoing need for a system to provide permanent, structurally sound school buildings in a reduced time frame. The system should provide a pitched roofline to facilitate shedding rain, snow, and debris and increased interior volume for a given floor area. However, the system should also be configured to be able to be transported over the road from the manufacturing facility to the building site in a substantially preassembled condition to reduce the time of construction. The system should provide a manner of securely fastening the structure to the foundation to provide increased strength in earthquake and extreme weather.

SUMMARY OF THE INVENTION

The aforementioned needs are satisfied by the modular school building system of the present invention. In one aspect, the modular school building system is a pre-assembled steel rigid building frame comprising a roof portion extensible between a first, flat configuration and a second, pitched configuration. The roof portion comprises a pivotable roof section and a slidable roof section wherein the pivotable roof portion and the slidable roof portion are pivotably attached. In one embodiment, pivotably attached comprises joining the pivotable roof section and the slidable roof section with a plurality of hinges. The modular school building system also comprises a lift adapted to move the frame from the flat configuration to the pitched configuration. The frame in the flat configuration is sized so as to fit under standard highway overpasses and bridges when the frame is loaded onto a standard low flatbed trailer. The modular school building system further includes anchor assemblies adapted to secure the frame to a building foundation.

In another aspect, the invention is a system for constructing buildings with a modular pre-assembled frame with a roof portion movable between a flat and a pitched position. The system includes a lift assembly that moves the roof portion between the flat position and the pitched position and anchor assemblies that secure the frame to a building foundation. The system also includes a plurality of fastening devices that secure the modular frame in the flat and in the pitched positions. The system in the flat position is sized so as to fit under standard highway overpasses and bridges and is thereby transportable over the road.

The system is used to construct a permanent structure by: transporting a plurality of modular frames to a building site; placing the plurality of modular frames on a prepared foundation with anchor assemblies installed therein; interconnecting the plurality of modular frames; interconnecting the modular frames to the prepared foundation with the anchor assemblies; moving the modular frames to the pitched position with the lift assembly; and installing pre-assembled interior wall assemblies. Known finishings materials such as exterior wall covering, roofing, plumbing, electrical and telephone wiring, HVAC system, and floor coverings are then installed to complete a permanent structure.

The region defined between the upper roof in the pitched configuration and the collar creates a dead air space that both increases the insulative properties of the completed building and provides a reservoir of air to reduce the demands on the HVAC system.

These and other objects and advantages of the present invention will become more fully apparent from the following description taken in conjunction with the accompanying drawings.

DETAILED DESCRIPTION OF THE PREFERRED EMBODIMENT

Figure 1:
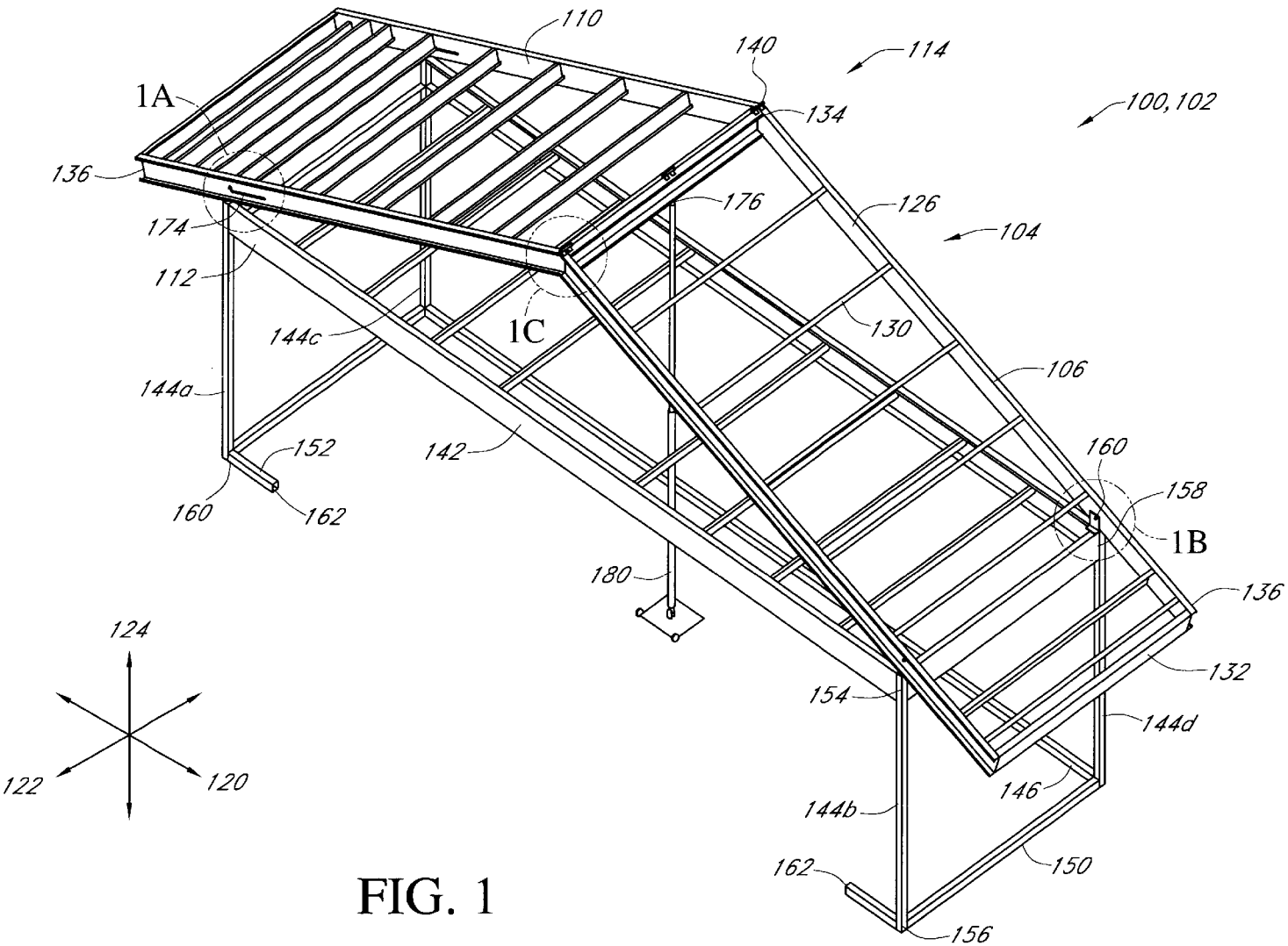
FIG. 1 is an isometric view of a frame module of the modular school building system in the pitched configuration.

Reference will now be made to the drawings wherein like numerals refer to like parts throughout. FIGS. 1, 1A, 1B, and 1C are isometric views of a modular school building system 100 comprising a frame module 102. The modular school building system 100 provides a substantially preassembled and preapproved design for constructing a permanent school building with a pitched roof. The modular school building system 100 is transportable over the road on standard trucks.

The frame module 102 of this embodiment is generally rectangular and constructed of steel c-channels and comprises a collar 112 and an upper roof 104. The upper roof 104 is movable between a pitched configuration 114 illustrated in FIG. 1 and a flat configuration 116 illustrated in FIG. 10. The pitched configuration 114 provides a sloping roof profile to the frame module 102 so that, when the frame module 102 is connected with other frame modules 102 and provided with other materials to comprise a completed building in a manner that will be described in greater detail below, the roof of the completed building has a pitch.

The pitched roof provided by the modular school building system 100 better sheds rain, snow, and dirt thereby making the modular school building system 100 suitable for regions of the country that are not suitable for standard portables. The pitched roof also provides longer mean life for the roofing materials because dirt, water, and snow will not as readily accumulate on the roof surface. The pitched roof profile further provides a dead air space within the cavity defined under the pitched roof to thereby improve the insulation factor of a building employing the modular school building system 100 particularly with respect to the thermal heating from incident sunlight.

The flat configuration 116 reduces the overall height of the frame module 102 compared to the pitched configuration 114 to thereby facilitate transportation of the frame module 102 in a manner that will be described in greater detail below. By enabling the modular school building system 100 to be readily transported over the road, the modular school building system 100 can be substantially pre-assembled at a remote manufacturing facility and transported to the building site. By facilitating manufacturing the modular school building system 100 at a dedicated remote site, the modular school building system 100 obtains the advantages of better dimensional uniformity of the frame modules 102, more reliable interconnection and alignment of the component pieces, and greater economy of scale as will be appreciated by one skilled in the art. By providing preapproved and pre-assembled frame modules 102, the modular school building system 100 reduces the time and expense necessary to construct school buildings as compared to ground up, custom construction because much of the construction is already done before the customer receives the modular school building system 100 and the lengthy plan approval process has already been performed.

The frame module 102 defines an x axis 120, a y axis 122 orthogonal to the x axis 120, and a z axis 124 orthogonal to both the x 120 and the y 122 axes as shown in FIG. 1. It should be understood that references to the x 120, y 122, and z 124 axes hereinafter maintain the same orientation illustrated in FIG. 1.

The upper roof 104 comprises a pivotable roof section 106 and a slidable roof section 110. The pivotable roof section 106 and slidable roof section 110 are generally rectangular and made of steel c-channel elongate members. The pivotable roof section 106 and slidable roof section 110 permit the frame module 102 to assume the pitched configuration 114 and the flat configuration 116 in a manner that will be described in greater detail below.

The pivotable roof section 106 and slidable roof section 110 are each comprised of two rafters 126, a plurality of cross-ties 130, and two end pieces 132. The rafters 126, cross-ties 130, and end pieces 132 are elongate members made of steel c-channel. The rafters 126, cross-ties 130, and end pieces 132, when interconnected, provide the structure and physical strength of the pivotable roof section 106 and the slidable roof section 110. A first end 134 and a second end 136 of each rafter 126 is attached to an end of an end piece 132 so as to form a generally rectangular, planar assembly. The plurality of cross-ties 130 are attached to the rafters 126 so as to extend from one rafter 126 to the other rafter 126 in a generally perpendicular manner along the y axis 122. The cross-ties 130 are disposed between the rafters 126 and the end pieces 132 so as to accommodate the installation of standard size roof substrate materials. By facilitating the use of standard size roof substrate materials, the modular school building system 100 further reduces the time and cost of constructing school buildings employing the modular school building system 100.

In this embodiment, attaching the rafters 126, end pieces 132, and cross-ties 130 together comprises welding. It should be appreciated that the attachment can also comprise connecting fasteners, adhesives, clinching, press fits, or other methods or materials for joining materials well known in the art.

Figure 1C:
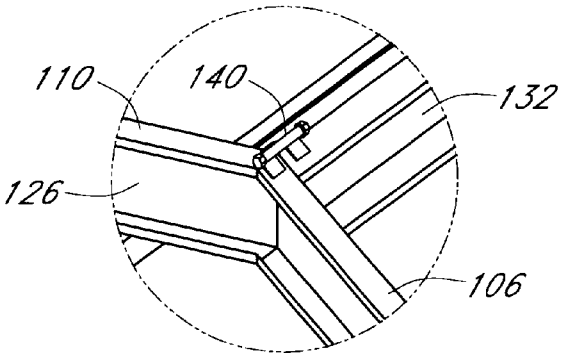
FIG. 1C is a close-up isometric view of the pivoting connection of the pivotable and slidable roof sections.
Figure 1B:
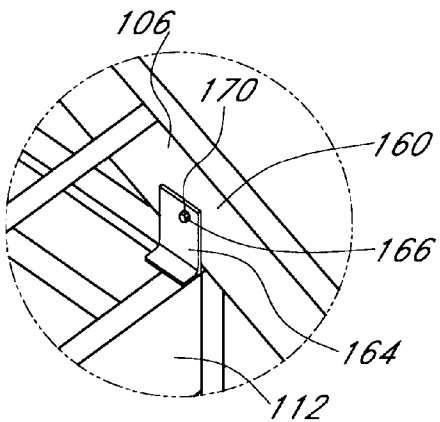
FIG. 1B is a close-up isometric view of a pivot assembly of the pivotable roof section.
Figure 1A:
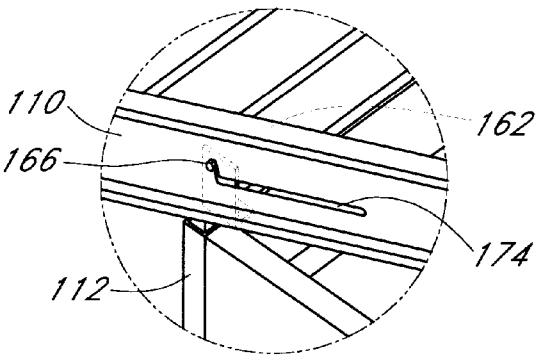
FIG. 1A, is a close-up view of the slotted portion of the slidable roof section.
Figure 4:
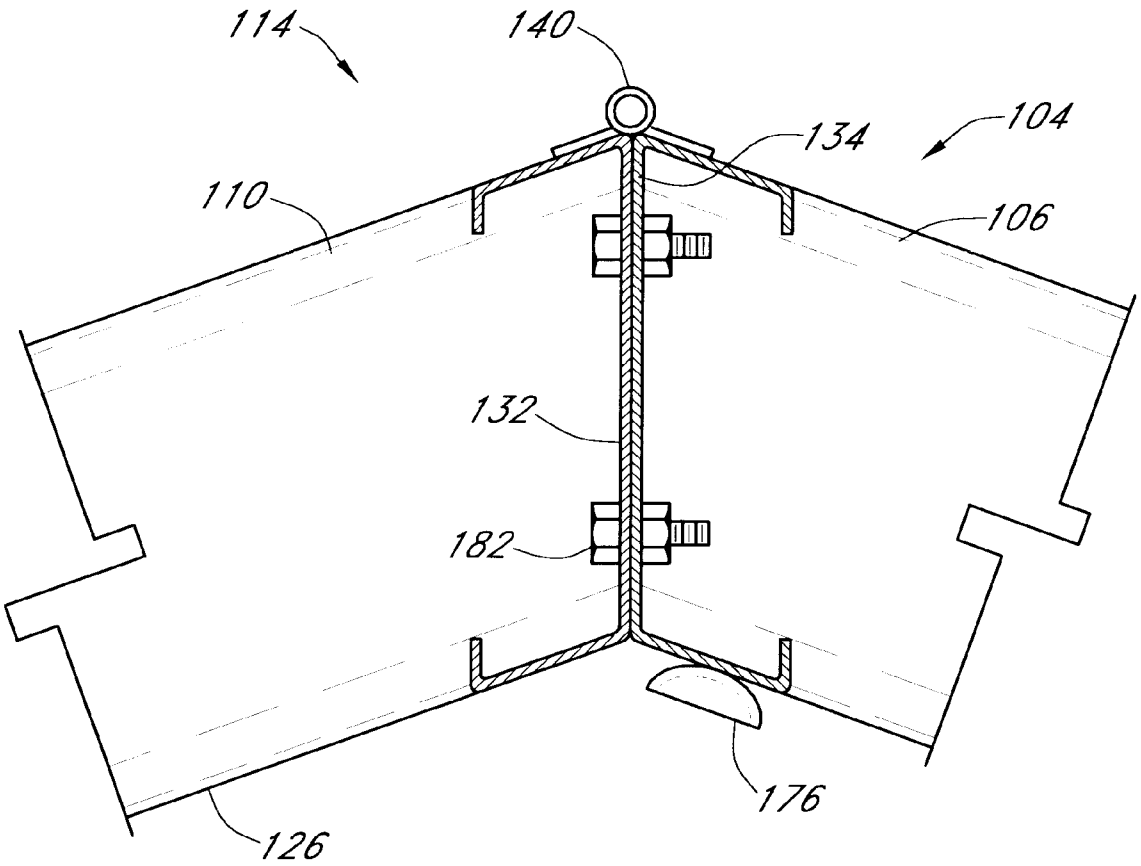
FIG. 4 is a section view of the upper roof secured in the pitched position.
Figure 5:
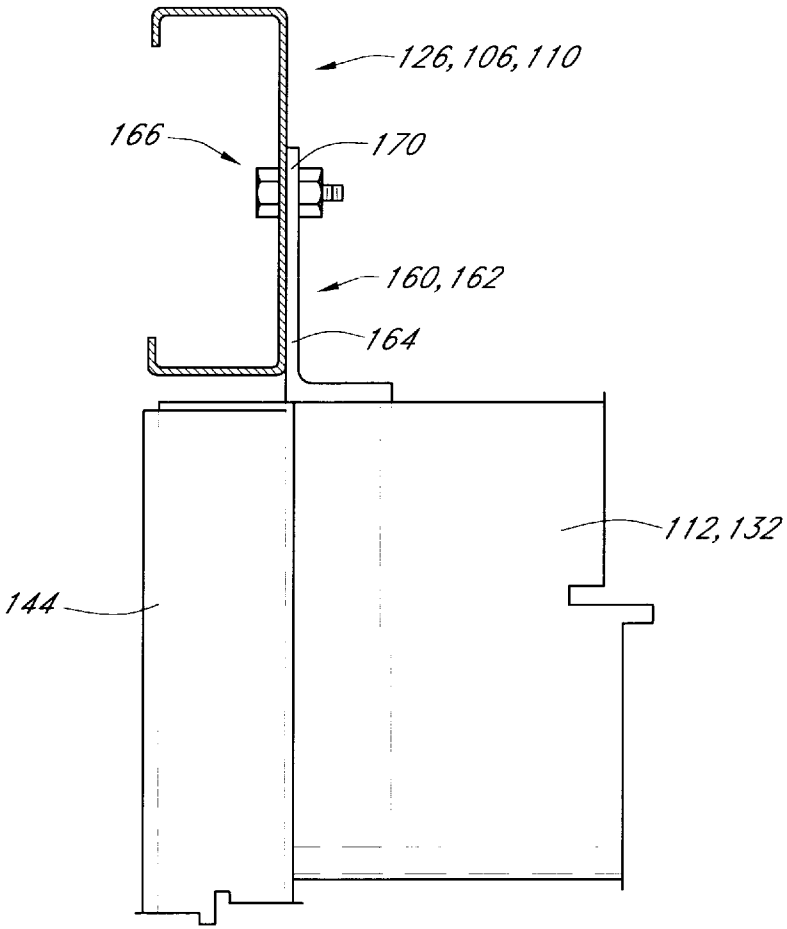
FIG. 5 is an end, section view of the pivot assembly or guide pin assembly portion of the upper roof.

The first ends 134 of the rafters 126 are cut on a bias, which in this embodiment is approximately 19° from square as shown in FIG. 1, FIG. 1C, and FIG. 4. The first ends 134 of the rafters 126 of the pivotable roof section 106 and slidable roof section 110 are positioned adjacent each other and substantially coplanar and pivotably connected so as to form the upper roof 104. In this embodiment, pivotably connecting the pivotable roof section 106 and slidable roof section 110 comprises joining the pivotable roof section 106 and slidable roof section 110 with a plurality of hinges 140 of a known type. In this embodiment, the hinges 140 are attached to the pivotable roof section 106 and slidable roof section 110 via welding.

The plurality of hinges 140 joining the adjacent pivotable roof section 106 and slidable roof section 110 allow the pivotable roof section 106 to pivot about the y axis 122 with the slidable roof section 110. The approximately 19° bias cut of the first ends 134 of the rafters 126 provide clearance to thereby allow the pivotable roof section 106 and slidable roof section 110 to move so as to form an approximately 142° included angle, thereby forming the pitched configuration 114 of the upper roof 104. The pitched configuration 114 of this embodiment is approximately a 4 in 12 pitch. The 4 in 12 pitch of the modular school building system 100 is known by those skilled in the art to provide an advantageous roof profile for shedding rain, snow, dirt and creating a dead air space under the roof profile.

The collar 112 is generally rectangular and approximately 12' by 40'. The collar 112 is made from steel c-channel elongate members. The collar 112 provides a horizontal, planar load bearing structure for the frame module 102 extending along the x 120 and y 122 axes and provides an attachment surface for finishing materials such as ceiling panels and insulation. The collar 112 comprises two ridge beams 142, a plurality of cross-ties 130, and two end pieces 132. An end of each perimeter beam 142 is attached to an end of an end piece 132 so as to form a generally rectangular, planar assembly. The plurality of cross-ties 130 are attached to the ridge beams 142 so as to extend from one perimeter beam 142 to the other perimeter beam 142 in a generally perpendicular manner along the y axis 122. The cross-ties 130 are disposed between the ridge beams 142 and the end pieces 132 so as to be approximately equidistantly spaced between the end pieces 132.

The frame module 102 also comprises vertical supports 144*a–d*, an outer wall sill 146, end sills 150, and anchor stubs 152. The vertical supports 144, outer wall sill 146, end sills 150, and anchor stubs 152 are made from 3/16" steel square tube, 4" by 4" in this embodiment. The vertical supports 144 are elongate members that are approximately 10" long and support and elevate the collar 112 and the upper roof 104. The outer wall sill 146 is an elongate member approximately 40" long and the end sills are elongate members approximately 12" long. An upper end 154 of each vertical support 144*a–d* is attached to a comer 158 of the collar 112 so as to extend along the z axis 124. A lower end 156 of the vertical supports 144*c* and 144*d* is attached to an end of the outer wall sill 146. The lower end 156 of each vertical support 144*a–d* is connected to an end of an end sill 150. The vertical supports 144*a–d*, the outer wall sill 146, and the end sills 150 are interconnected so that the vertical supports 144*a–d* extend along the z axis 124, the outer wall sill 146 extends along the x axis 120, and the end sills 150 extend along the y axis 122, thereby defining the rectangular frame module 102 with the collar 112 and the upper roof 104. In this embodiment, the attachment comprises welding.

The anchor stubs 152 are approximately 3' long in this embodiment and provide attachment points for securing the anchor stubs 152 and thereby the frame module 102 to anchor structures set in a building's foundation to thereby anchor the frame module 102 against uplift and horizontal movement with respect to the foundation. A first end 160 of each anchor stub 152 is attached to the lower end 156 of the vertical supports 144*a* and 144*b* so that the anchor stubs 152 extend along the x axis 120 and further so that second ends 162 of the anchor stubs 152 are proximal.

The interconnection of the collar 112, the vertical supports 144, the outer wall sill 146, the end sills 150, and the anchor stubs 152 provides a rigid structure that can be readily moved about from the place of manufacture to the work site and at the work site. Thus, the modular school building system 100 can employ the advantages of pre-assembled structures previously described.

The frame module 102 also comprises pivot assemblies 160 and guide pin assemblies 162 as shown in FIGS. 1, 2, 3, and 5. The pivot assemblies 160 and guide pin assemblies 162 locate and secure the pivotable roof section 106 and the slidable roof section 110 to the collar 112. The pivot assemblies 160 and guide pin assemblies 162 comprise a bracket 164 and a pin 166. In this embodiment, the bracket 164 is an "L" shaped piece formed from ½" steel plate and is approximately 7"×6"×3". The pin 166 of this embodiment is a ⅝" high strength bolt and corresponding nut of a known type extending along the y axis 122. A bracket 164 is attached to each comer 158 of the collar 112 extending upwards.

Each bracket 164 and the second ends 136 of the rafters 126 of the pivotable roof section 106 are provided with a hole 170. The hole 170 provides clearance for the pin 166 to pass through, which in this embodiment, is approximately ⅝" in diameter. The pin 166 passes through the holes 170 and thus through the rafters 126 and the bracket 164 along the y axis 122. Thus the pins 166 secure the rafters 126 and thus the pivotable roof section 106 during erection of the upper roof 104 to the brackets 164 and thus the collar 112 so as to restrict lateral translation of the pivotable roof section 106 along the x 120, y 122, and z 124 axes and also so as to restrict rotation about the x 120 and z 124 axes, but so as to permit rotation about the y axis 122.

Figure 2:
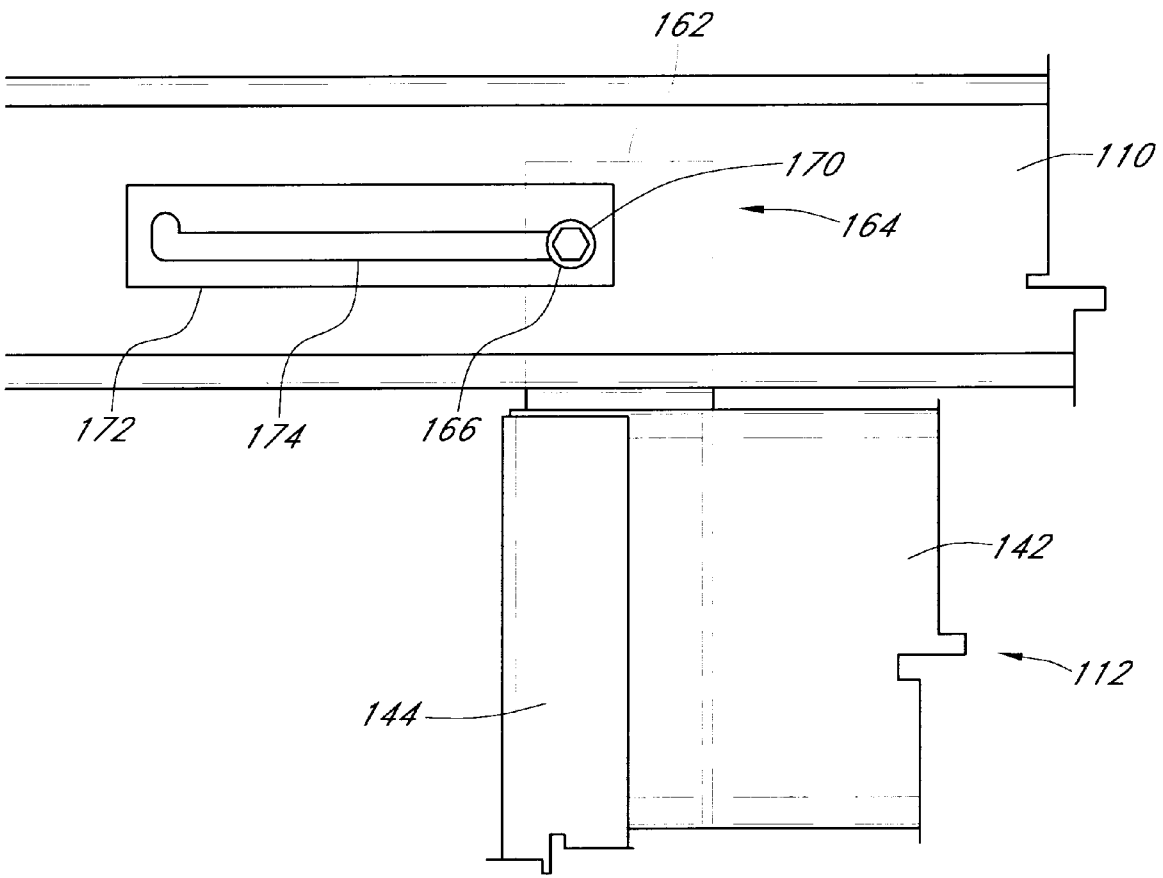
FIG. 2 is a detail side view of the slidable roof section and slot in the flat configuration.
Figure 3:
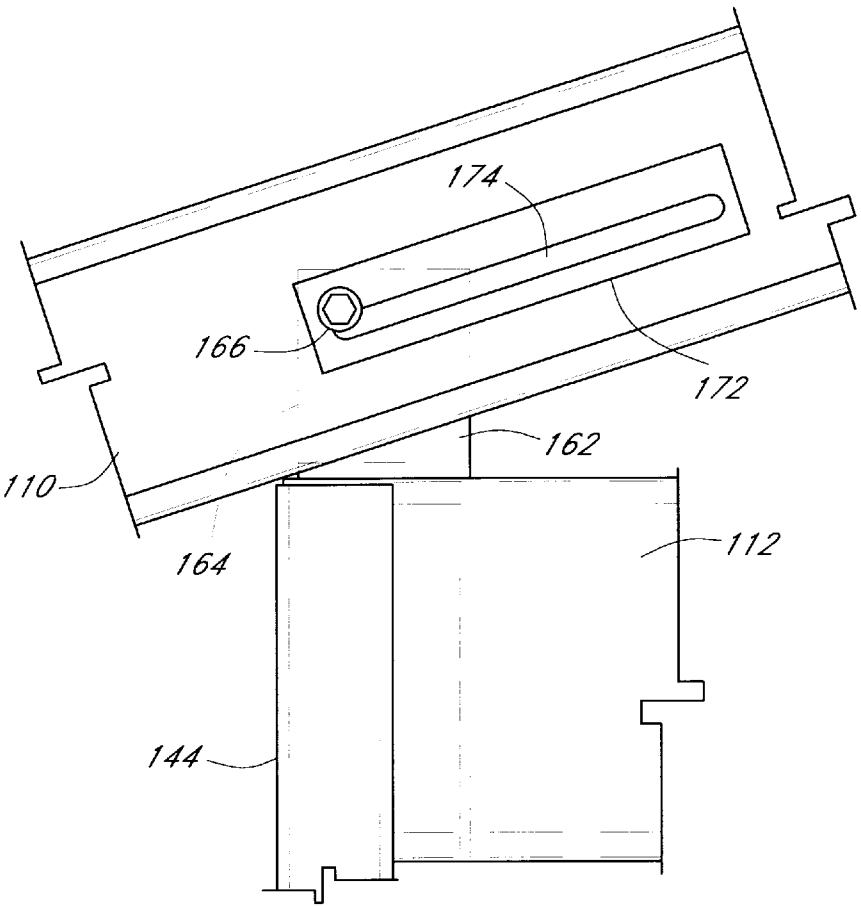
FIG. 3 is a detail side view of the slidable roof section and slot in the pitched configuration.

The second end 136 of the rafters 126 of the slidable roof section 110 are provided with reinforcement plates 172 and slots 174 as shown in FIGS. 2 and 3. The reinforcement plates 172 of this embodiment are ¼" steel plate approximately 3"×16" and are welded to the rafters 126 of the slidable roof section 110 adjacent the second end 136. The reinforcement plates 172 provide increased structural strength to the rafters 126 to support the upper roof 104 and to secure the upper roof 104 to the collar 112. The slots 172 are through going openings in the reinforcement plates 172 and the rafters 126. The slots are generally "L" shaped and in this embodiment are approximately ⅝" slots 26" long by 1½" wide as shown in FIG. 2.

The pins 166 pass through the slots 174 and the brackets 164 so as to secure the rafters 126 and thus the slidable roof section 110 to the collar 112 during erection of the upper roof 104 so as to restrict translation of the slidable roof section 110 along the y 122 and z 124 axes and allow a limited degree of translation along the x axis 120 and also so as to restrict rotation of the slidable roof section 110 along the x 120 and z 124 axes yet allow rotation about the y axis 122.

The upper roof 104 also comprises a lifting attachment 176 as shown in FIGS. 1, 4, 9, and 10. The lifting attachment 176 is attached to the underneath of the end piece 132 adjacent the first end 134 of the pivotable roof section 106. The lifting attachment 176 removable attaches to an end of a lift 180. In this embodiment, the lifting attachment 176 defines a socket and the end of the lift 180 defines a corresponding ball. The lift 180 is a hydraulically extensible jack of a type well known in the art. The lift 180 is positioned underneath the lifting attachment 176 extending vertically along the z axis 124 and further positioned such that the end of the lift 180 mates with the lifting attachment 176. The lift 180 is then manipulated such that the lift 180 extends. Extension of the lift 180 urges the lifting attachment 176 and thus the first end 134 of the pivotable roof section 106 upwards. As the second end 136 of the pivotable roof section 106 is restrained as previously described, the pivotable roof section 106 pivots upwards such that the first end 134 is elevated relative to the second end 136 and the collar 112.

The first ends 134 of the pivotable roof section 106 and the slidable roof section 110 are pivotably connected as previously described. Thus, as the first end 134 of the pivotable roof section 106 is elevated by the lift 180, the first end 134 of the slidable roof section 110 is correspondingly elevated. As the pivotable roof section 106 and the slidable roof section 110 are two rigid bodies pivotably connected, as the line of connection is elevated relative to the ends, the upper roof 104 triangulates as the lift 180 elevates the lifting attachment 176. Since the second end 136 of the pivotable roof section 106 is restricted from translation along the x axis 120, as the first ends 134 of the pivotable roof section 106 and slidable roof section 110 are elevated by the lift 180, the second end 136 of the slidable roof section 110 moves inwards along the x axis 120 as the pins 166 move within the slots 174.

As the first ends 134 of the pivotable 106 and slidable 110 roof sections move upwards, the pins 166 move within the slots 174 of the slidable roof section 110 until the slidable roof section 110 drops into the end of the slots 174 as shown in FIG. 3. The pins 166 are then fastened so as to secure the pivotable 106 and slidable 110 roof sections from further movement in a known manner. Securing fasteners 182 are placed through the first ends 134 of the pivotable 106 and the slidable 110 roof sections to further interconnect the pivotable 106 and the slidable 110 roof sections as shown in FIG. 4. The fasteners 182 of this embodiment are ⅝" hex bolts and corresponding nuts of known types. The fasteners 182 are secured to the pivotable 106 and the slidable 110 roof sections in a well known manner. The lift 180 is then retracted and removed and the upper roof 104 is thus placed and secured in the pitched configuration 114.

Figure 6:
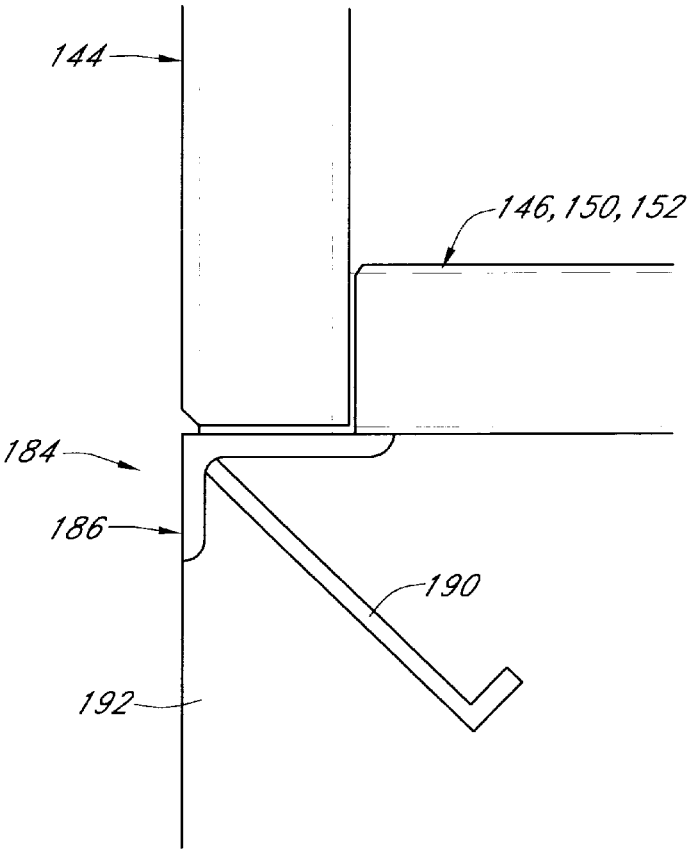
FIG. 6 is a section view of a typical anchor assembly set in a foundation footing and connected to the frame module.

The modular school building system 100 also comprises a plurality of anchor assemblies 184 as shown in FIG. 6. The anchor assemblies 184 interconnect the frame modules 102 to the building's foundation footings 192 to restrict uplift and horizontal displacement forces acting on the building due to seismic events or high wind conditions. The anchor assemblies 184 of this embodiment comprise an angle 186 and two anchor bolts 190. The angle 186 is an "L" shaped piece of ½" steel plate approximately 5"×3½"×8". The anchor bolts 190 are ½" "L" shaped threaded rods approximately 8" long. The foundation footing 192 in this embodiment is a concrete slab of a type well known in the art.

In this embodiment, the anchor bolts 190 are connected to the angle 186 by welding in a known manner so as to form the anchor assemblies 184. The anchor assemblies 184 are set in the foundation footing 192 so as to rest flush with the surface of the foundation footing 192 prior to the formation of the foundation footing 192 in the manner illustrated in FIG. 6. The rigid and massive structure of the foundation footing 192 enclosing the anchor assemblies 184 provides high resistance of the anchor assemblies 184 to tensile and compression forces acting on the anchor assemblies 184 along the x 120, y 122, and z 124 axes.

The anchor assemblies 184 are then rigidly connected to the vertical supports 144, the outer wall sills 146, end sills 150, and the anchor stubs 152. In this embodiment, the connection comprises welding in a known manner. Thus the vertical supports 144, the outer wall sills 146, end sills 150, and the anchor stubs 152 are rigidly connected to the anchor assemblies 184 and thus to the foundation footing 192. Thus vertical and horizontal forces acting on the frame module 102 are transferred through the vertical supports 144, the outer wall sills 146, end sills 150, and the anchor stubs 152 to the anchor assemblies 184 and thus to the foundation footing 192. Thus vertical and horizontal forces acting on the building are resisted by the modular school building system 100 and damage to the building is thereby inhibited. The interconnection of the frame modules 102 to the anchor assemblies 184 provides a steel moment resisting frame along both the x 120 and the y 122 axes.

Figure 7:
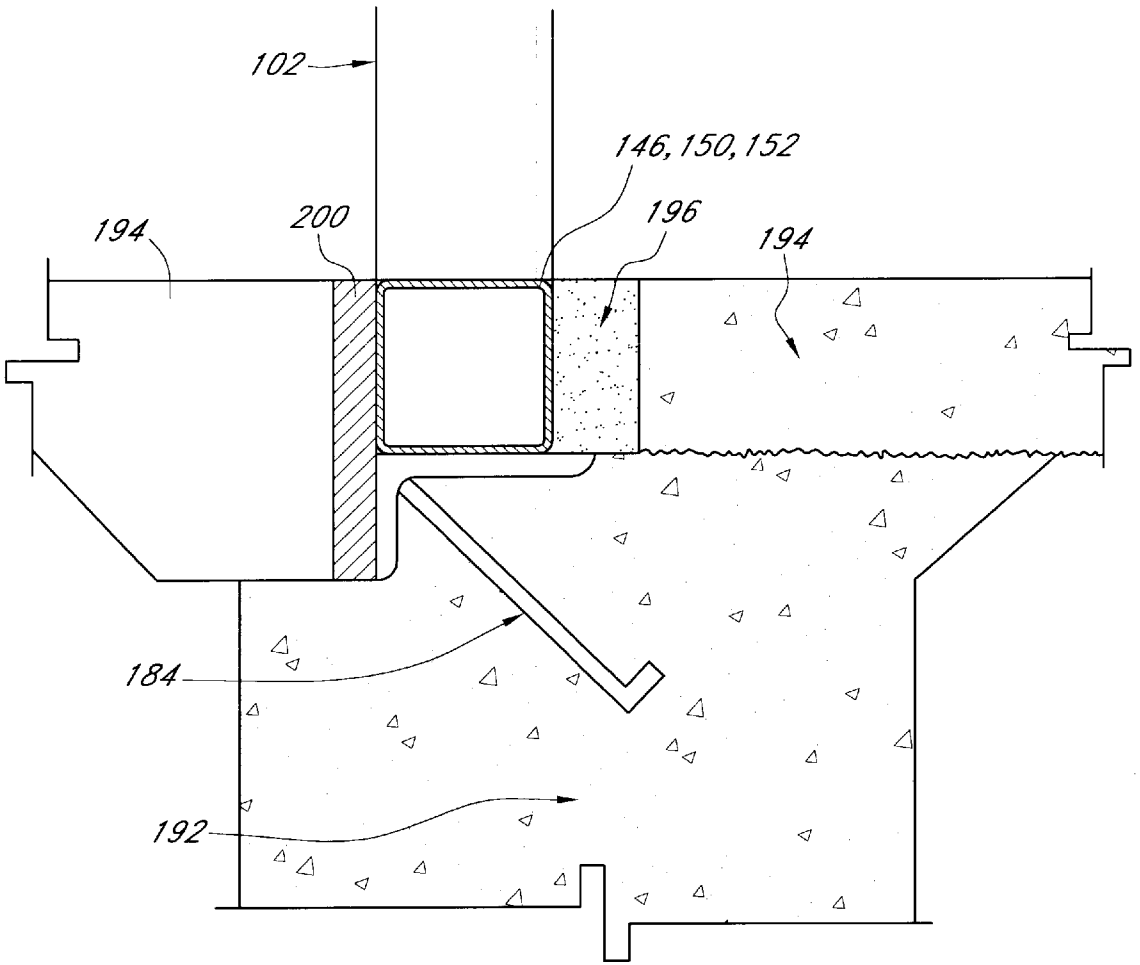
FIG. 7 is a section view of the modular school building system with a typical anchor assembly set in a foundation footing, connected to a frame module, and with the foundation floor slab in place.

After the frame modules 102 are connected to the anchor assemblies 184 in the manner previously described, a floor slab 194, rigid filler 196, and resilient filler 200 are emplaced on and around the foundation footings 192 and the frame modules 102 as shown in FIG. 7. In this embodiment, the floor slab 194 is a planar layer of concrete approximately 4" thick poured to encase the anchor stubs 152, end sills 150, and outer wall sills 146 so that the surface of the floor slab 194 is flush with the upper surfaces of the anchor stubs 152, end sills 150, and outer wall sills 146 in a well known manner. The rigid filler 196 comprises grout and the resilient filler 200 comprises bituminous expansion material. The rigid filler 196 and resilient filler 200 fill the cavity defined between the edge of the floor slabs 194 and the anchor stubs 152, end sills 150, and outer wall sills 146. The rigid filler 196 and resilient filler 200 provide additional strength to the modular school building system 100 by providing additional physical support between the foundation footing 192, the floor slab 194, and the frame module 102. The resilient filler 200 provides a restricted freedom of movement between the floor slab 194 and the frame module 102 to accommodate differential thermal expansion between the floor slab 194 and the frame module 102 during temperature changes.

Figure 8:
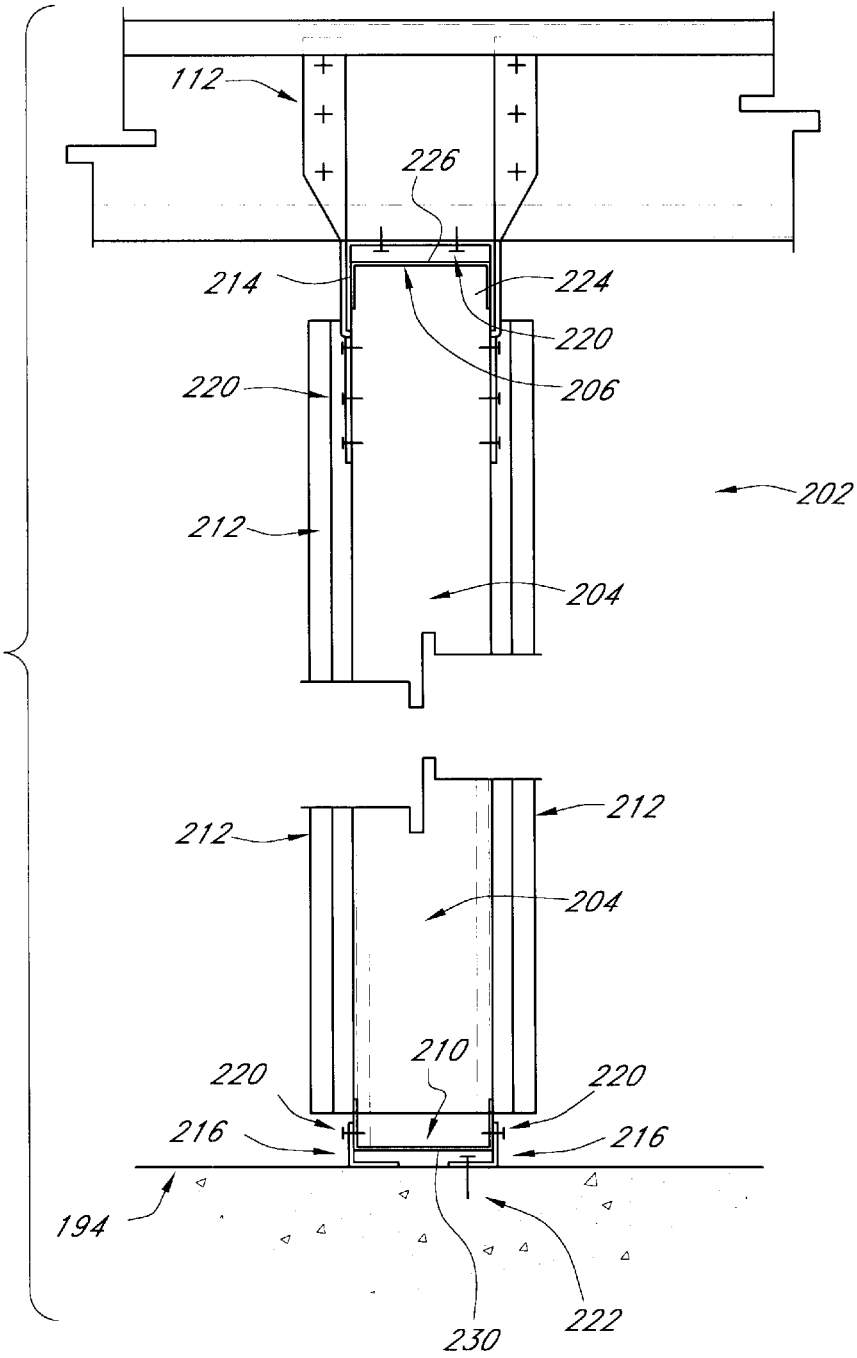
FIG. 8 is a section view of a typical interior wall assembly.

The modular school building system 100 also comprises interior wall assemblies 202 as shown in FIG. 8. The interior wall assemblies 202 are generally rectangular and in this embodiment are approximately 9'×4'×6". The interior wall assemblies 202 are non-load-bearing structures that extend from the floor slab 194 to the collar 112 and partition the interior of the frame modules 102. The interior wall assemblies 202 comprise pre-assembled wall panels 204. The wall panels 204 are generally rectangular and in this embodiment are approximately 9'×4'×6". The wall panels 204 comprise a steel frame and insulation constructed in a well known manner.

The interior wall assemblies 202 also comprise interior finishings 212. The interior finishings 212 are generally rectangular and, in this embodiment, are approximately 9'×4'×½". The interior finishings 212 of this embodiment comprise sheet rock panels of a type well known in the art. The interior finishings 212 are placed adjacent to the wall panels 204 and aligned with the wall panels 204 so as to be parallel. The interior finishings 212 are attached to both sides of each wall panel 204 with fasteners 220 so as to be adjacent and aligned with the major plane of the wall panels 204 in a well known manner. In this embodiment, the fasteners 220 comprise Number 10 sheet metal screws. The interior finishings 212 provide additional structural strength and insulation to the interior wall assemblies 202 and further provide an advantageous surface for the application of known coverings such as paint, wood paneling, and wall paper.

The interior wall assemblies 202 also comprise a header channel 206 and footer channel 210. The header 206 and footer 210 channels of this embodiment are made of c-channel channel 20 gauge steel and are approximately 4'×4"×1½". The header 206 and footer 210 channels define interior cavities 224 as shown in FIG. 8. The header 206 and footer 210 channels are positioned such that a top edge 226 of the wall panel 204 occupies the interior cavity 224 of the header channel 206 and the bottom edge 230 of the wall panel 204 occupies the interior cavity 224 of the footer channel 210. Thus the header 206 and footer 210 channels are adjacent the top 226 and bottom 230 edges respectively of the wall panel 204. The header 206 and footer 210 channels are attached to the wall panel 204 in a well known manner with fasteners 220, which in this embodiment, comprise Number 10 sheet metal screws placed approximately 16" on center.

The interior wall assemblies 202 also comprise a ceiling track 214. The ceiling track 214 is an elongate member made of 16 gauge steel c-channel approximately 4"×2½" in cross section. The length of the ceiling track 214 is dependent on the placement of the corresponding interior wall assembly 202 and the overall dimensions of the building employing the modular school building system 100, however would be obvious to one skilled in the art. The ceiling track 214 also defines an interior cavity 224. The interior cavity 224 and thus the ceiling track 214 is sized such that the top edge 226 of the wall panel 204 with the header channel 206 connected in the manner previously described, fits snuggly within the interior cavity 224 of the ceiling rack 214. The ceiling track 214 is positioned adjacent the collar 112 preferably extending along the x 120 or the y 122 axes such that the interior cavity 224 faces downwards along the z axis 124. The ceiling track 214 is attached to the collar 112 with a plurality of fasteners 220 in a well known manner. In this embodiment, the fasteners 220 are Number 10 sheet metal screws placed no more than 24" on center.

The interior wall assemblies also 202 comprise footing braces 216. The footing braces 216 are elongate members made of 16 gauge 90° steel angle approximately 1½"×1½". The length of the footing braces 216 is preferably substantially equal to the length of a corresponding ceiling track 214 selected in the manner indicated above. A first footing brace 216 is placed adjacent the floor slab 194 so as to be parallel with and aligned to the corresponding ceiling track 214. The first footing brace 216 is attached to the floor slab 194 with fasteners 222 in a well known manner. In this embodiment, the fasteners 222 are 0.145" diameter concrete nail placed no more than 24" on center.

The top edge 226 of the wall panel 204 with the attached header channel 206 is placed into the interior cavity 224 of the ceiling track 214 such that the top edge 226 of the wall panel 204 is approximately ½" away from the collar 112 as measured along the z axis 124. The wall panel 204 is then positioned so as to be vertically aligned along the z axis 124 such that the bottom edge 230 of the wall panel 204 with the attached footer channel 210 is adjacent the first footing brace 216. The second footing brace 216 is then positioned adjacent to and aligned with the bottom edge 230 of the wall panel 204 so as to be parallel with the first footing brace 216 and so as to fit tightly against the floor slab 194 to thereby stabilize the wall panel 204. The bottom edge 230 of the wall panel 204 is then attached to the first and second footing braces 216 with a plurality of fasteners 220 in a known manner. In this embodiment, the fasteners 220 are Number 10 sheet metal screws placed no more than 16" on center.

Thus the interior wall assembly 202 is secured at the top edge 226 to the ceiling track 214 and thus the collar 112 and the bottom edge 230 is secured to the footing braces 216 and thus the floor slab 194. The approximately ½" spacing between the wall panel 204 and the collar 112 provides clearance for a limited deflection of the collar 112 without loading the interior wall assembly 202.

Figure 9:
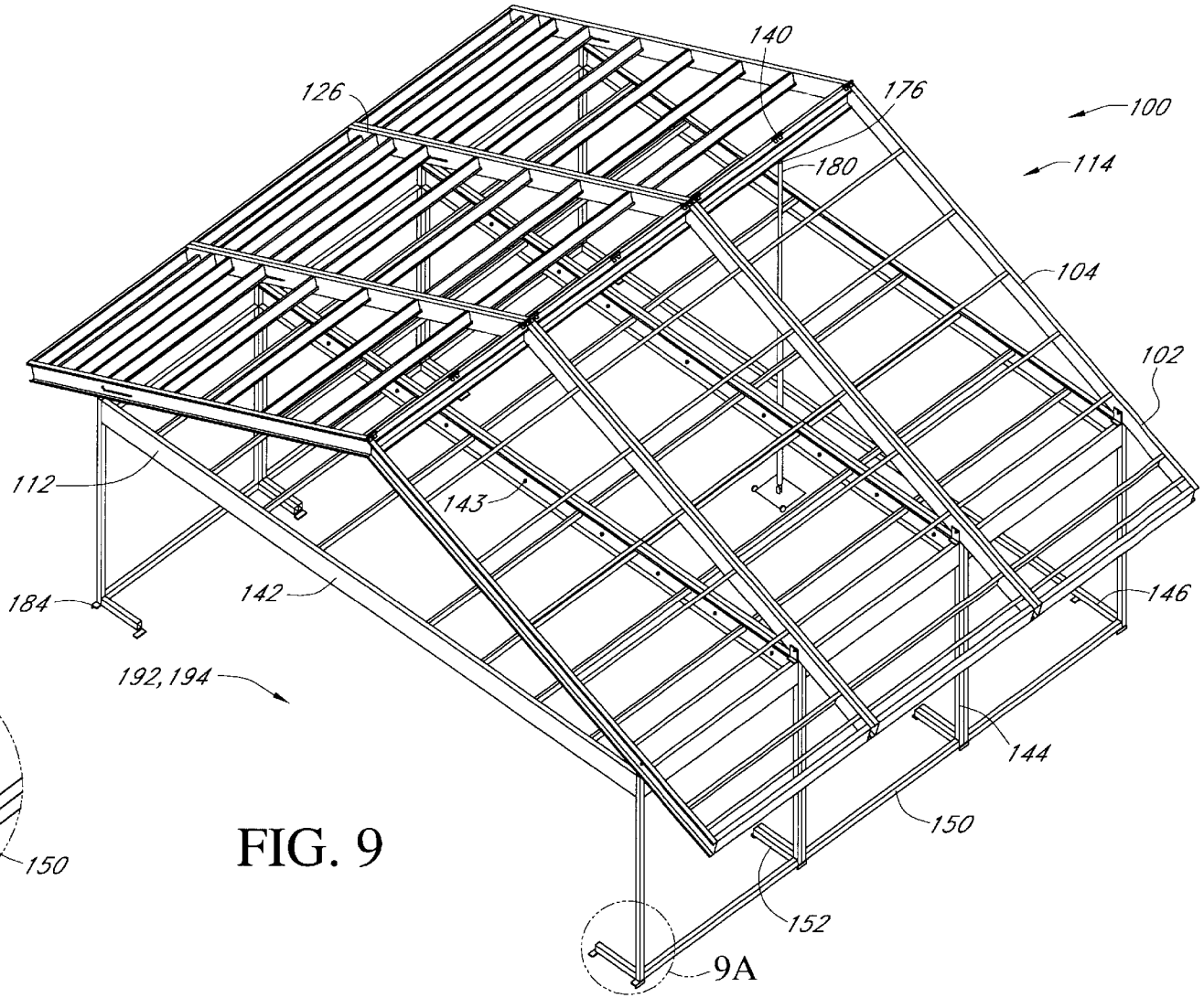
FIGS. 9 and 9A are isometric views of three frame modules interconnected together and also anchored to the foundation.
Figure 9A:
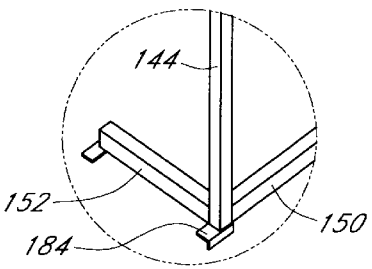

FIG. 9 illustrates three frame modules 102 interconnected together and anchored to the floor slab 194. In this embodiment, the anchor assemblies 184 are placed within the foundation footings 192 in the manner previously described. Then the frame modules 102 are placed on the foundation footings 192 such that the anchor stubs 152 are all aligned with a corresponding anchor assembly 184. The anchor stubs 152, end sills 150, and outer wall sill 146 are then connected to the anchor assemblies 184 in the manner previously described. The three frame modules 102 are then interconnected to each other along the vertical supports 144 and adjacent ends of the end sills 150 and the anchor stubs 152. In this embodiment, interconnecting the vertical supports 144 and adjacent ends of the end sills 150 and the anchor stubs 152 comprises welding, however, it should be appreciated that interconnecting can also be adapted by one skilled in the art to include fasteners, adhesives, clinches, or other methods of joining materials. The frame modules 102 are further connected along adjacent perimeter beams 142 with a plurality of fasteners 143. The fasteners 143 of this embodiment are ⅝" bolts and corresponding nuts placed and secured to the perimeter beams 142 approximately 8" on center in a known manner.

The lift 180 is then positioned to mate with the lifting attachments 176 of the frame modules 102 and manipulated so as to raise the frame modules 102 to the pitched configuration 114 in the manner previously described. Adjacent rafters 126 of the frame modules 102 are interconnected, in this embodiment, with a plurality of fasteners 220 placed approximately 8" on center along the major axis of the rafters 126 so as to form a contiguous upper roof 104 in the pitched configuration 114. The lift 180 is then distanced from the frame modules 102 and the interior wall assemblies 202 are then installed in the manner previously described. Then appropriate building materials such as plumbing, electrical and telephone wiring, ceiling panels, carpeting, and roofing is applied to the modular school building system 100 to complete a school building in a known manner. It should be appreciated that the exact order of assembly of the modular school building system 100 and manner of finishing materials employed can be readily modified by one skilled in the art to meet the needs of particular applications without detracting from the spirit of this invention.

Figure 10:
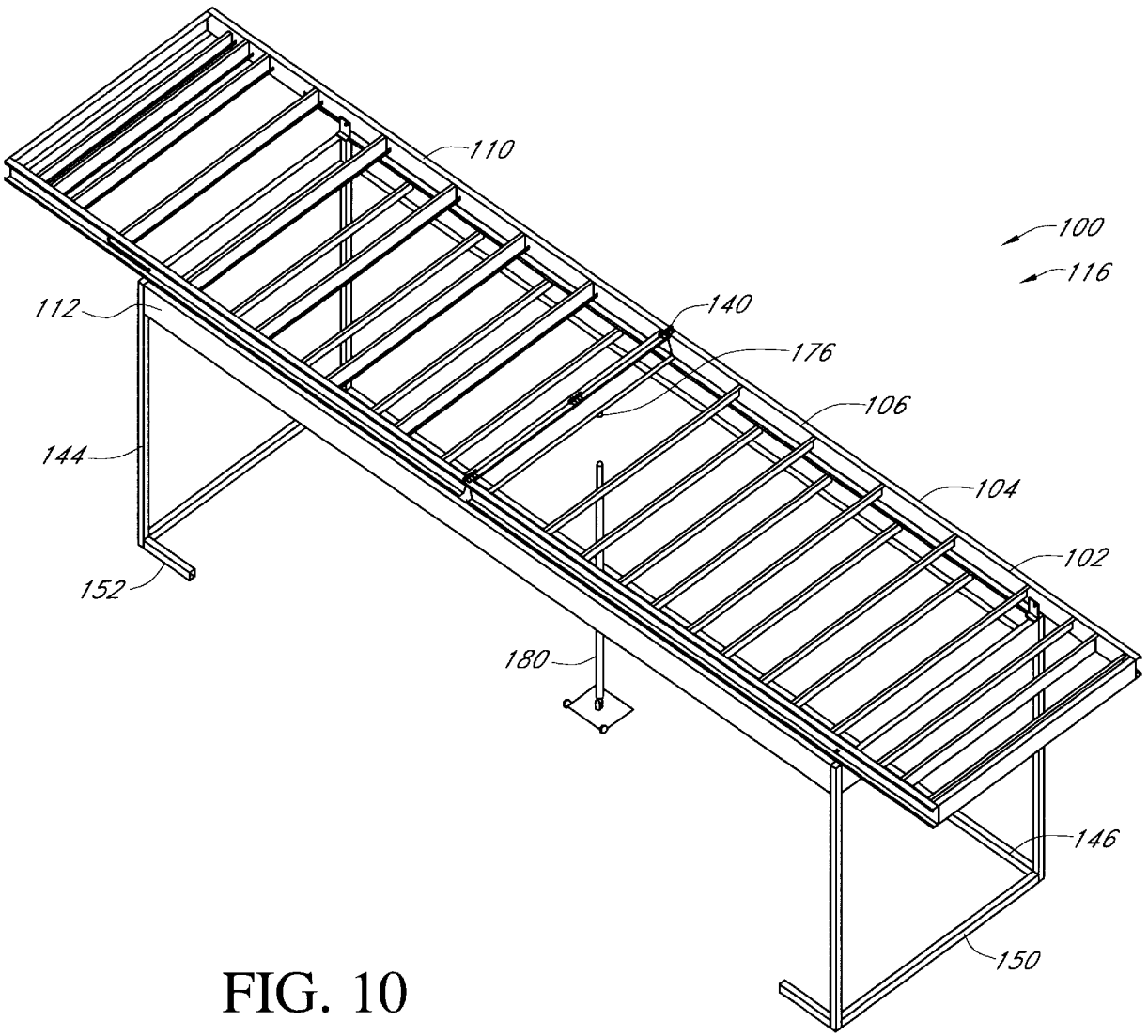
FIG. 10 is an isometric view of a frame module in the flat configuration.

FIG. 10 illustrates a frame module 102 of the modular school building system 100 in the flat configuration 116. As can be appreciated from comparing the illustrations of FIG. 10 and FIG. 1, the overall height of the frame module 102 in the flat configuration 116 is substantially less than its height in the pitched configuration 114. In this embodiment, the height of the frame module 102 in the flat configuration 116 is approximately 11½'. The frame module 102 is also approximately 12' wide by 40' long. As will be appreciated by one skilled in the art, the frame module 102 of approximately 11½'×12'×40' in the flat configuration 116 can be readily loaded onto a standard low flat-bed trailer and transported over the road without interference with standard highway overpasses and bridges. Thus, the modular school building system 100 can be readily transported in a substantially pre-assembled state from the point of manufacture to the intended building site. Thus, the modular school building system 100 provides increased economy and speed of construction to the building trades.

Although the preferred embodiments of the present invention have shown, described and pointed out the fundamental novel features of the invention as applied to those embodiments, it will be understood that various omissions, substitutions and changes in the form of the detail of the device illustrated may be made by those skilled in the art without departing from the spirit of the present invention. Consequently, the scope of the invention should not be limited to the foregoing description but is to be defined by the appended claims.

What is claimed is:

1. A pre-assembled rigid building frame comprising a first and a second side wall sections adapted to be mounted to a foundation and a roof section, wherein the roof section is attached to the first and second side wall sections so that the roof section can be positioned in a lowered configuration during transportation of the building frame to the building site and a raised configuration after the building frame has been transported to the building site, wherein the roof section comprises a pivotable roof section having a first and a second end wherein the pivotable roof section is pivotally attached at a first end to the first side wall section and a slidable roof section having a first and a second end wherein the slidable roof section is slidably interconnected at a first end to the second side wall section.

2. The frame of claim 1, wherein the second ends of the pivotable roof section and the slidable roof section are pivotally attached to each other so that -the roof section can be moved between the lowered configuration and the raised configuration by exerting an upward force towards the second ends of the pivotable and slidable roof sections to thereby raise the second ends of the pivotable and slidable roof sections relative to the first ends of the pivotable and slidable roof sections.

3. The frame of claim 2, further comprising a securing mechanism that secures the roof section in the raised configuration.

4. The frame of claim 3, wherein the second side wall section includes a slide member and wherein the slidable roof section includes an elongate slot formed at a location so as to receive the slide member to permit interconnected sliding movement of the slidable roof section relative to the second side wall section in a direction substantially perpendicular to the plane of the second side wait section.

5. The frame of claim 4, wherein the slot includes a recess into which the slide member is positioned when the roof section is in the raised configuration so as to inhibit the roof section from moving from the raised configuration to the lowered configuration.

6. The frame of claim 5, wherein the slide member is adapted to be secured to the slidable roof section when the slide member is positioned in the recess so as to further inhibit the roof section from moving from the raised configuration to the lowered configuration.

7. The frame of claim 6, wherein the securing mechanism further comprises fasteners that interconnect the second ends of the slidable roof section and the pivotable roof section when the roof section is in the raised configuration so as to inhibit the slidable roof section and pivotable roof sections from moving with respect to each other in a manner that would result in the roof section moving from the raised configuration toward the lowered configuration.

8. The frame of claim 1, wherein the frame in the lowered configuration has a vertical height that is sized so as to fit under standard highway overpasses and bridges when the frame is loaded onto a standard truck.

9. The frame of claim 1, wherein the first and second side wall sections includes a collar that interconnects the upper portions of the first and second sidewall sections.

10. The frame of claim 1, wherein the first and second sidewall sections includes a upper track mounted on an upper portion of the first and second sidewall sections so as to define a cavity.

11. The frame of claim 10, further comprising at least one pre-assembled wall panel suitable for attaching wall board thereto, the wall panel having a header that can be positioned within the cavity defined by the upper track and secured therein so as to secure the wall panel to the upper portion of the side wall sections.

12. The frame of claim 11, further comprising a bottom track mountable to the foundation of the building at a position that is aligned with the position of the upper track, wherein the bottom track defines a cavity that receives the bottom end of the wall panel so as to secure the wall panel to the foundation.

13. The frame of claim 12, wherein the upper track is comprised of a C-channel member and the bottom track is comprised of two L-shaped members that are positioned so as to define a C-shaped channel.

14. The frame of claim 12, wherein the pre-assembled wall panel is attached to the upper track and the bottom track so that the wall panel defines a non-load bearing wall within the building.

15. The frame of claim 1, wherein the first and second side wall sections include vertical supports having an upper and a lower end.

16. The frame of claim 15, further comprising at least one anchor assembly that anchors the lower end of the vertical supports to the ground.

17. The frame of claim 15, wherein the at least one anchor assembly comprises:

a footing positioned in the ground;

an anchor member positioned within the footing; and a plate attached to the anchor member so as to be positioned on an upper surface of the footing wherein one of the vertical supports of the first side wall is attached to the plate to thereby anchor the first side wall to the ground.

18. A method of constructing a frame of a building comprising:

forming a foundation for the building on a building site;

transporting a plurality of pre-assembled building frame sections to the building site, wherein each of the pre-assembled building frame sections have two side wall frames spaced apart and a roof having a pivotable section attached to one of the two side wall frames and a slidable section slidably interconnected to the other side wall frame wherein the roof section is positioned in a lowered configuration during transport;

anchoring the plurality of pre-assembled building frame sections to the foundation on the building site so that the plurality of building sections are positioned such that the side wall frames of each section are aligned with each other so as to define the side wall frames of the building; and moving the roof section of each of the pre-assembled building frame sections from the lowered configuration into a raised configuration such that the pivotable roof section pivots and the slidable roof section slides in an interconnected fashion with the respective side walls following delivery of the building frame sections to the job site.

19. The method of claim 18, wherein forming the foundation for a building site comprises:

forming a plurality of footings;

positioning an anchor member within the footing; and attaching a plate to the anchor member so that the plate is positioned on the upper surface of the footing.

20. The method of claim 19, wherein anchoring the plurality of pre-assembled building frame sections to the foundation comprises attaching frame member of the side wall frames to the plate positioned on the footings.

21. The method of claim 20, wherein attaching the frame member of the side wall frames to the plate comprises welding the frame members to the plate.

22. The method of claim 20, wherein forming the foundation for the building site further comprises:

forming a floor slab so as to define a trench in which the plate is positioned such that the bottom of the trench corresponds to the upper surface of the footings; and positioning a grout material within the trench following attachment of the frame member to the foundation.

23. The method of claim 22, further comprising positioning a resilient material within the trench following attachment of the frame member to the foundation.

24. The method of claim 18, wherein transporting the plurality of pre-assembled assembled building frame sections to the building site comprises transporting a plurality of pre-assembled assembled frame building sections having two side wall sections with a first and second roof member respectively attached thereto wherein the first roof member is pivotally attached to a first side wall section and the second roof member is slidably interconnected to the second side wall section and wherein the first and second roof members are pivotally attached to each other.

25. The method of claim 24, wherein moving the roof section of each of the pre-assembled building frame sections into the raised configuration comprises exerting an upward force against the interconnected portions of the first and second roof members so as to cause the first roof member to pivot and the second roof member to slide to thereby raise the interconnected portion of the first and second roof members to thereby provide a frame for a roof of the building that has a pre-defined angle of pitch.

26. The method of claim 18, further comprising attaching pre-assembled wall panels suitable for receiving wall board to the two side wall frames of the building frame sections.

27. The method of claim 26, wherein attaching pre-assembled wall panels to the two side wall frames comprises:

attaching a channel member to an upper region of the side wall member so as to define a cavity;

positioning an upper portion of the pre-assembled wall panel within the cavity; and securing the upper portion of the pre-assembled wall panel to the channel member.

28. The method of claim 27, further comprising:

forming a channel member on the foundation so as to define a cavity and so that the channel member on the foundation is aligned with the channel member on upper region of the side wall member;

positioning a lower portion of the pre-assembled wall panel within the cavity; and securing the lower portion of the pre-assembled wall panel to the channel member on the foundation.

29. The method of claim 18, further comprising interconnecting the plurality of pre-assemble building frame sections following anchoring of the plurality of pre-assembled building frame sections to the foundation.

30. A method of constructing a frame of a building comprising:

forming a foundation for the building on a building site;

transporting a plurality of pre-assembled building frame sections to the building site, wherein each of the pre-assembled building sections have two side wall frames interconnected so as to be spaced apart to thereby define a three-dimensional structure; and anchoring the plurality of pre-assembled building frame sections along laterally extending anchor stubs to the foundation on the building site so that the plurality of building sections are positioned such that the side wall frames of each building frame section are aligned with each other so as to define the side walls of the building.

31. The method of claim 30, wherein transporting a plurality of pre-assembled building frame sections to the building site comprises transporting a plurality of building frame sections having two side wall frames and a roof section attached to the two side wall frames wherein the roof section is positioned in a lowered configuration during transport.

32. The method of claim 31, further comprising moving the roof section of each of the pre-assembled building frame sections from the lowered configuration into a raised configuration following delivery of the building frame sections to the job site.

33. The method of claim 32, wherein transporting the plurality of pre-assembled assembled building frame sections to the building site comprises transporting a plurality of pre-assembled assembled building frame sections having two side wall sections with a first and second roof member respectively attached thereto wherein the first roof member is pivotally attached to a first side wall section and the second roof member is slidably interconnected to the second side wall section and wherein the first and second roof members are pivotally attached to each other.

34. The method of claim 33, wherein moving the roof section of each of the pre-assembled building frame sections into the raised configuration comprises exerting an upward force against the interconnected portions of the first and second roof members so as to cause the first roof member to pivot and the second roof member to slide to thereby raise the interconnected portion of the first and second roof members to thereby provide a frame for a roof of the building that has a pre-defined angle of pitch.

35. The method of claim 30, wherein forming the foundation for a building site comprises:

forming a plurality of footings;

positioning an anchor member within the footing; and attaching a plate to the anchor member so that the plate is positioned on the upper surface of the footing.

36. The method of claim 35, wherein anchoring the plurality of pre-assembled building frame sections to the foundation further comprises attaching frame members of the side wall frames to the plate positioned on the footings.

37. The method of claim 36, wherein attaching the frame members of the side wall frames to the plate comprises welding the frame members to the plate.

38. The method of claim 35, wherein forming the foundation for the building site further comprises:

forming a floor slab so as to define a trench in which the plate is positioned such that the bottom of the trench corresponds to the upper surface of the footings; and positioning a grout material within the trench following attachment of the frame sections to the foundation.

39. The method of claim 38, further comprising positioning a resilient material within the trench following attachment of the frame section to the foundation.

40. The method of claim 30, further comprising attaching pre-assembled wall panels suitable for receiving wall board to the two side wall frames of the building frame sections.

41. The method of claim 40, wherein attaching pre-assembled wall panels to the two side wall frames comprises:

attaching a channel member to an upper region of the side wall member so as to define a cavity;

positioning an upper portion of the pre-assembled wall panel within the cavity; and securing the upper portion of the pre-assembled wall panel to the channel member.

42. The method of claim 41, further comprising:

forming a channel member on the foundation so as to define a cavity and so that the channel member on the foundation is aligned with the channel member on upper region of the side wall member;

positioning a lower portion of the pre-assembled wall panel within the cavity; and securing the lower portion of the pre-assembled wall panel to the channel member on the foundation.

43. A pre-assembled roof section for a building comprising:

a collar member having a first and a second end wherein the collar member is adapted to be mounted to side wall frame members of the building;

a first roof frame member, the first roof frame member being pivotably attached to the first end of the collar member; and a second roof frame member, the second roof frame member being slidably interconnected to the second end of the collar member and wherein the first and second roof frame members are movable between a lowered position and a raised position such that the roof frame members in the lowered position reduce the overall height of the pre-assembled roof section to facilitate transport of the pre-assembled roof section to a building site and wherein the roof frame members in the raised positioned results in a roof frame that defines a pitched roof.

44. The roof section of claim 43, wherein an outer end of the first roof frame member is pivotally attached to the first end of the collar member and wherein an outer end of the second roof fame member is slidably interconnected to the second end of the collar member.

45. The roof section of claim 44, wherein inner ends of the first and second roof frame members are pivotally attached to each other so that when the roof section is in the raised position, the center of the roof section is raised with respect to outer ends of the roof section.

46. The roof section of claim 43, further comprising a securing mechanism that secures the roof section in the raised position.

47. The roof section of claim 46, wherein the second end of the collar includes a slide member and wherein the second roof frame member includes an elongate slot formed at a location so as to receive the slide member to permit interconnected sliding movement of die second roof frame member relative to tie second end of the collar member in a first direction.

48. The roof section of claim 47, wherein the slot includes a recess into which the slide member is positioned when the roof section is in the raised position so as to inhibit the roof section from moving from the raised position to the lowered position.

49. The roof section of claim 48, wherein the slide member is adapted to be secured to the collar member when the slide member is positioned in the recess so as to further inhibit the roof section from moving from the raised position.

50. The roof section of claim 49, wherein the securing mechanism further comprises fasteners that interconnect inner ends of the fiat and second roof frame members when the roof section is in the raised configuration so as to inhibit the roof section from moving from the raised position.

* * * * *

UNITED STATES PATENT AND TRADEMARK OFFICE

CERTIFICATE OF CORRECTION

PATENT NO. : 6,519,900 B1
DATED : February 18, 2003
INVENTOR(S) : Alan Pierce

It is certified that error appears in the above-identified patent and that said Letters Patent is hereby corrected as shown below:

Column 12,
Line 42, please change “wait” to -- wall --

Column 15,
Lines 26 and 28, please change “pre-assembled assembled building” to -- pre-assembled building --

Column 18,
Line 1, please change “fiat” to -- first --

Signed and Sealed this

Eleventh Day of May, 2004

JON W. DUDAS
*Acting Director of the United States Patent and Trademark Office*